United States Patent [19]

Cox et al.

[11] 4,222,627

[45] Sep. 16, 1980

[54] PULLOUT FUSE HOLDER

[75] Inventors: Russell Cox, Frankfort; Joseph C. Drilling, Lexington; Ronald H. Reed, Versailles, all of Ky.

[73] Assignee: Square D Company, Palatine, Ill.

[21] Appl. No.: 962,354

[22] Filed: Nov. 20, 1978

[51] Int. Cl.[2] ..... H01R 7/02

[52] U.S. Cl. ..... 339/147 R; 339/198 N; 361/349

[58] Field of Search ..... 339/147 R, 198 R, 198 N, 339/198 H, 198 J, 186 R, 186 M, 113 R, 113 B, 22 B; 337/199, 211, 213, 215; 361/427, 349, 353

[56] References Cited

U.S. PATENT DOCUMENTS

| | | | |
|---|---|---|---|
| 2,137,919 | 11/1938 | Lorenz | 337/199 X |
| 2,193,201 | 3/1940 | Millermaster | 337/211 X |
| 3,202,788 | 8/1965 | George | 337/213 X |
| 3,215,899 | 11/1965 | Meacham | 361/353 |
| 3,265,830 | 8/1966 | Kobryner | 337/211 X |
| 3,346,777 | 10/1967 | Leonard et al. | 361/427 X |
| 3,588,619 | 6/1971 | Layton | 361/427 X |
| 3,842,322 | 10/1979 | Leonard | 361/427 X |

*Primary Examiner*—Paul A. Bell
*Assistant Examiner*—Eugene F. Desmond
*Attorney, Agent, or Firm*—Norton Lesser; Richard T. Guttman

[57] ABSTRACT

The following specification describes a pullout fuse holder having a cover and a base with asymmetrically arranged stop walls permitting the cover carrying fuses and terminals to be assembled in one orientation to the base for interconnecting line and load terminals and to be assembled to the base in another orientation to store the fuses without interconnecting the line and load terminals.

6 Claims, 6 Drawing Figures

PULLOUT FUSE HOLDER

FIELD OF THE INVENTION

This invention relates in general to pullout fuse holders and more particularly to an improved and more economical pullout fuse holder of the type adapted to interconnect a respective bus bar and load.

SUMMARY OF THE PRIOR ART

Pullout fuse holders usually include a base or holder carrying line and load terminals and receiving a cover carrying fuses. A pair of cover terminals detachably connected to each end of a respective fuse are adapted to connect to the base line and load terminals in response to insertion or assembly of the cover to the base. If it is desired to disconnect the lines from the load the cover is removed to disconnect the cover terminals from the line and load terminals.

A problem is then presented in storing the cover and fuses especially in industrial environments and since the base line terminal is then also exposed, a hazard exists, unless covered.

One advantageous solution to this problem is shown in U.S. Pat. No. 3,202,788, where the cover and base terminals are asymmetrically arranged relative to the cover and base respectively so that the cover in one orientation connects the fuses on assembly to the base and in another orientation misaligns the cover and base terminals to prevent the completion of a circuit therebetween. This arrangement while effective requires more material than desired in order to provide the asymmetrical arrangement of the parts.

SUMMARY OF THE INVENTION

The present invention is directed to a pullout fuse holder comprising a base and cover with the cover carrying a plurality of symmetrically arranged fuses, each having symetrically arranged identical terminals.

The cover is adapted to be received in a base having symmetrically positioned identical female line side and load side terminals for each fuse with the line side terminals adapted to be connected to respective bus bars. The bus bars are of rectangular cross-section arranged in a stacked array with spaced flat surfaces adapted to be engaged by jaws secured to the line side terminals and are of the type sold by the Square D Company under the trademark I-LINE busway.

A plurality of asymmetrically arranged stops are provided on the cover and a plurality of asymmetrically arranged stops are provided on the base. Therefore when the cover is assembled to the base in one orientation the symmetrically positioned terminals carried by the cover extend a connection through the respective fuses carried by the cover and if assembled to the base in another orientation, the stops engage to prevent engagement between the cover terminals and the holder terminals. Suitable indicia on the cover and holder indicate the connected or stored condition respectively of the fuses.

Thus the cover may be conveniently stored in the base and prevent inadvertent contact with the base terminals, while the male and female terminals may be of respective identical construction and symmetrically positioned relative each other.

It is therefore one object of the present invention to provide an improved pullout fuse holder containing means for conveniently and economically storing fuses in an associated base.

It is another object of the present invention to provide a more economical pullout fuse holder capable of retaining a cover in either a fuse connecting or fuse disconnecting position and for providing clear indicia of each condition.

Other objects of this invention will become apparent on examination of the following specification together with the claims and the accompanying drawings.

DESCRIPTION OF THE PREFERRED EMBODIMENT

Figure 1:
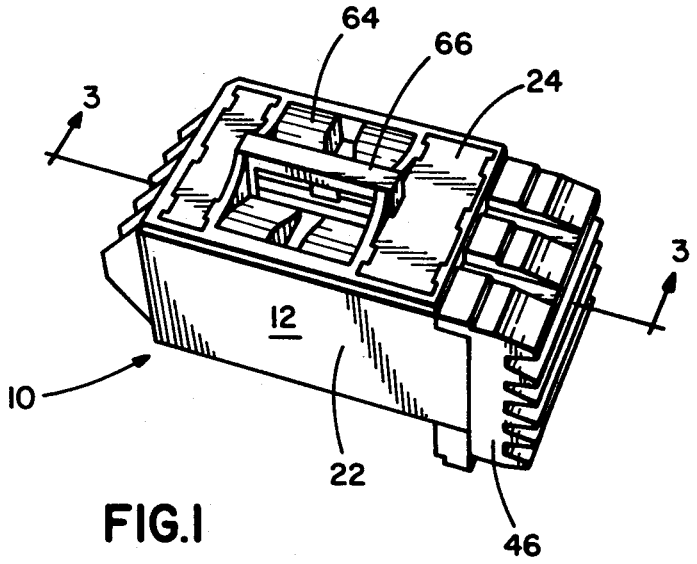
FIG. 1 is an isometric view of a pullout fuse holder incorporating the principles of the present invention.
Figure 2:
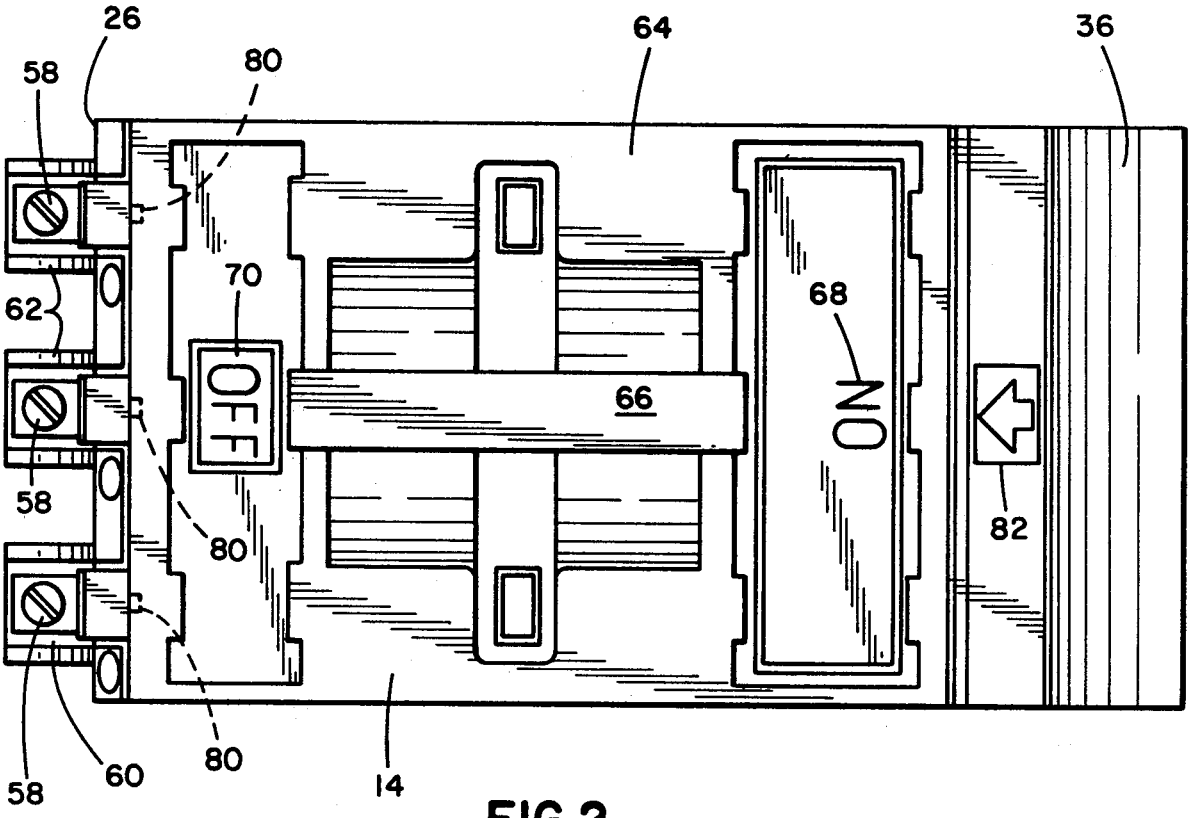
FIG. 2 is a top elevational view of the fuse holder shown in FIG. 1.

In FIGS. 1 and 2 a pullout fuse holder or box is indicated by the reference character 10. The fuse holder comprises a housing or base 12 having a cover 14 carrying a plurality of spaced parallel cartridge type fuses 16.

The base 12 includes a bottom wall 20 having longitudinally extending spaced side walls 22 and spaced end walls 24 and 26 defining a perimeter wall for an opening or recess 28 of the base in which the cover 14 is received as best seen in FIGS. 3-6.

The wall 20 is provided with a plurality of spaced steps 30 adjacent wall 24 and a passage 32 in each step enables an L-shaped blade or male terminal 34 connected to a respective fuse flip 36 to engage between the spring fingers of female line side terminal or terminal means 38. Terminal 38 is connected to a respective bus bar terminal 40 and each is secured in common to a shelf wall 42. Terminal 40 has a pair of jaws 43 at the end opposite terminal 38 and the jaws project into a respective one of vertically spaced passageways 44, **44*a*, and 44*b*, for example, formed in a shroud 46**.

Shroud 46 is secured to the corresponding end of base 12 and each passageway 44, etc. receives a respective one of a plurality of vertically stacked bus bars indicated by dashed lines 48 to enable the respective jaws 43 to connect thereto and receive incoming or line current of a respective phase. In addition an adapter 50 is secured to a depending portion of wall 20 adjacent the end of base 12 opposite shroud 46 and may serve to anchor the opposite end of the fuse holder. The jaws, adapter and shroud are similar to corresponding apparatus disclosed in U.S. Pat. Nos. 3,346,777, 3,588,619 and 3,842,322.

The fuse clip 36 together with terminal 34 are secured to the lower surface of cover 14 adjacent one end of the cover and the clip conventionally connects and secures one terminal of a respective cartridge fuse 16. The other terminal of the respective cartridge fuse 16 is connected and secured in a fuse clip 52 to suspend the respective fuse from the cover. A blade or male terminal 54 identical to terminal 34 and extending from the fuse clip 52 engages between spring fingers of a female load side terminal or terminal means 56 identical to terminal 38 to connect each fuse to a respective load terminal 58. The blade receiving end of terminal 56 is seated in a well or recess formed in the bottom wall 20 for engagement with terminal 54 and a shank portion thereof extends through a respective passage in end wall 26 for securement with the respective load terminal 58 to a shelf wall 60. Partition walls 62 extend between the respective load terminals 58 to minimize electrical leakage and the chance of inadvertent contact therewith.

Figure 3:
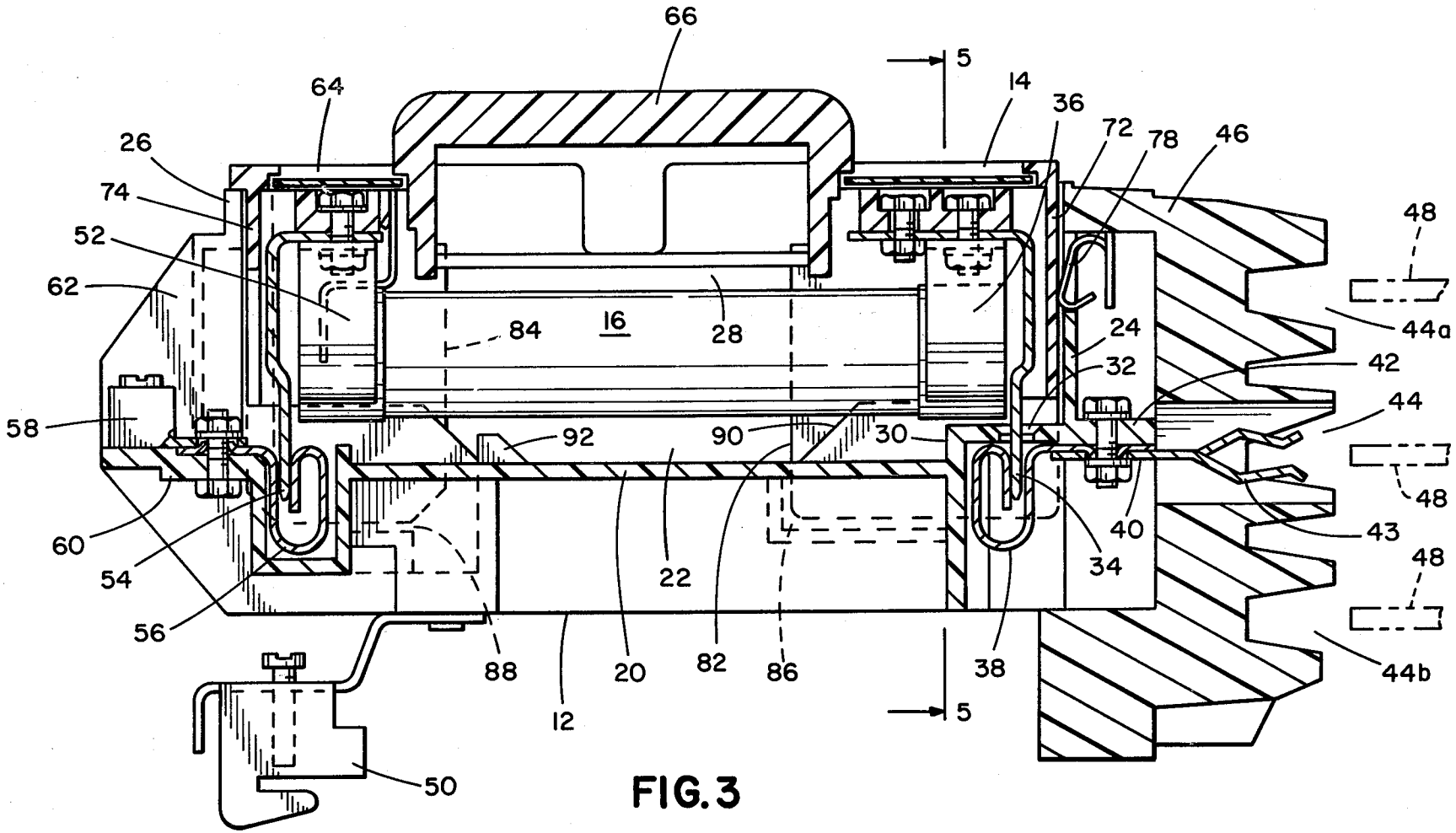
FIG. 3 is a sectional view taken through the line 3—3 in FIG. 1.
Figure 4:
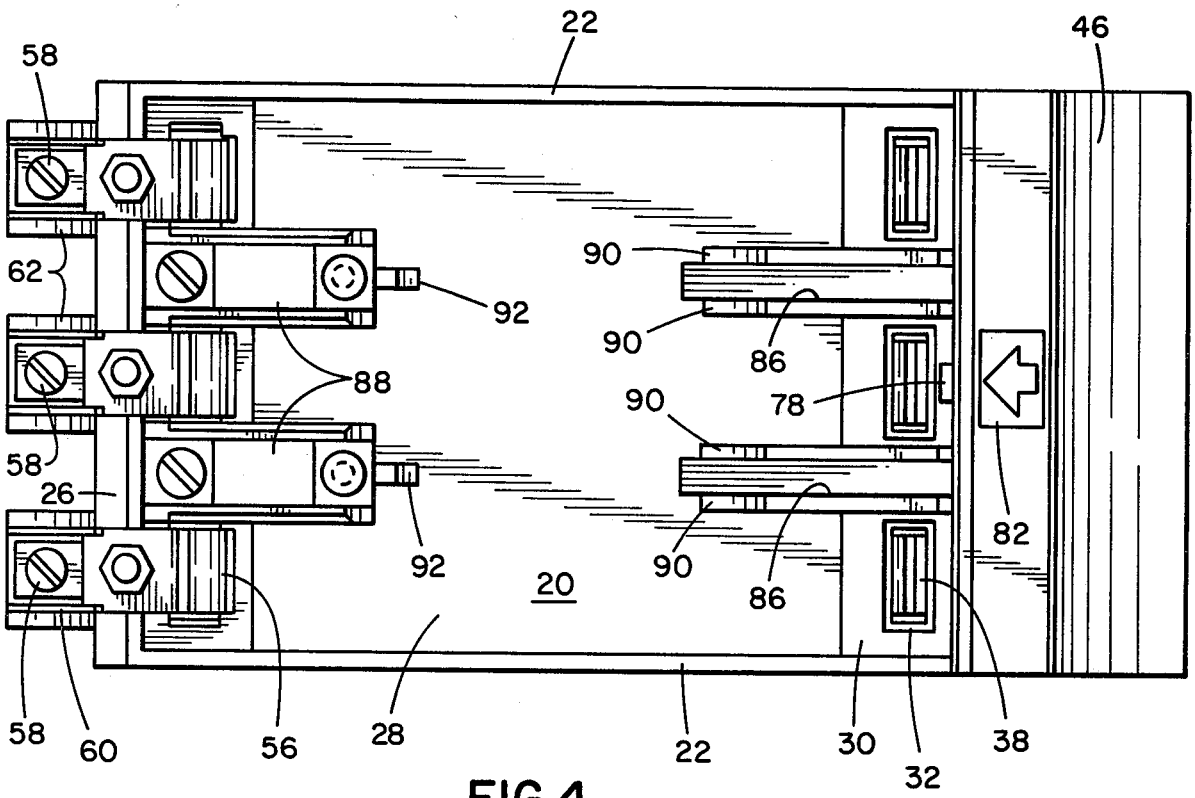
FIG. 4 is a top elevational view of the base.
Figure 5:
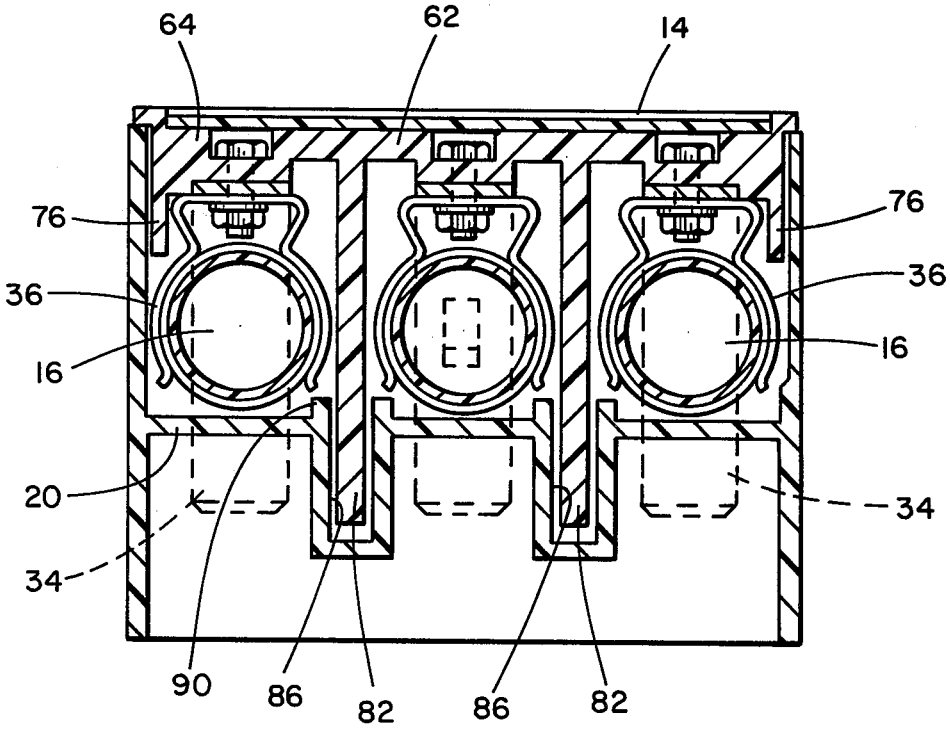
FIG. 5 is a sectional view taken through the line 5—5 in FIG. 3.
Figure 6:
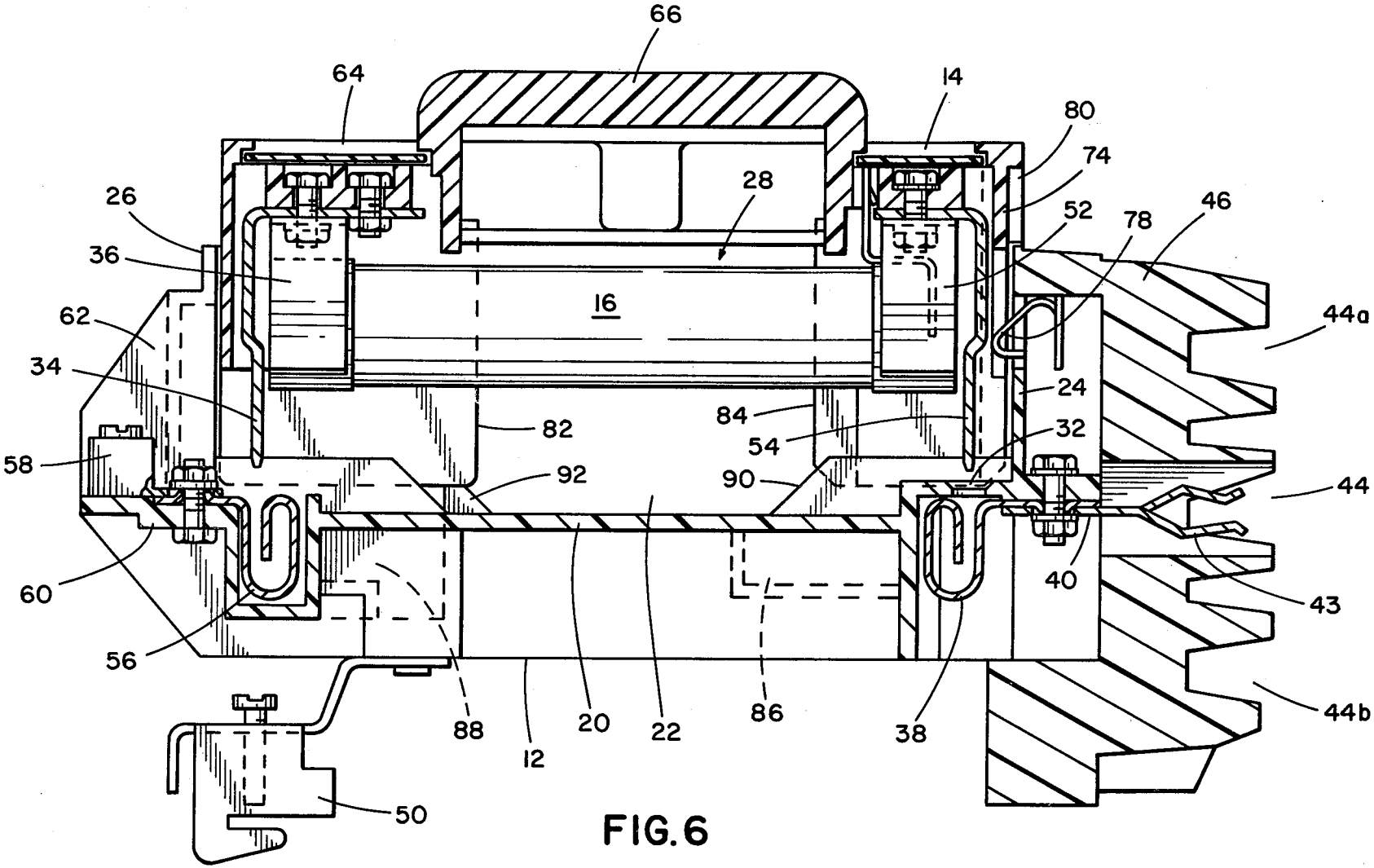
FIG. 6 is a sectional view similar to FIG. 3, but showing the cover and fuses in stored condition.

As best seen in FIGS. 3, 5 and 6 the cover has a top wall 64 spanning the opening 28 to bottom on the top edge of base 12 with a handle 66 projecting upwardly therefrom. Indicia 68 and 70 reading ON and OFF respectively are formed on the upper surface of the cover adjacent a respective longitudinal end of the cover. The cover 14 also is provided with respective end walls 72 and 74 adjacent the respective indicia and longitudinally extending side walls 76 forming a perimeter wall adapted to be received in recess 28 in response to movement along the axis of the housing perimeter wall.

End wall 72 overlaps a portion of each blade 34, while wall 74 overlaps a portion of each blade 54. A spring detent 78 is secured in a recess of the shroud and projects through wall 24 to provide a retention force for the cover. Wall 74 is also provided with spaced projections or stop walls 80 best seen in FIG. 6 and projecting therefrom beneath a rim portion of cover wall 64. Walls 80 are engaged in the passage portion of wall 26 when the cover is arranged as shown in FIG. 3 in one orientation to align and engage each terminal 34 and 54 with a respective one of terminals 38 and 56 and the cover side walls 76 and end walls 72 and 74 with a respective housing side wall 22 and end walls 24 and 26 when the cover is in ON position. At that time the arrow indicated at indicia 82 on the top surface of holder 10 is directly adjacent the indicia ON of the cover 14 and the blade terminals 34 and 54 engage terminals 38 and 56 respectively to enable completion of a circuit from the bus bars 48 to respective load terminals 58.

In addition to the stop walls 80, a plurality of spaced partition walls 82 and 84 located between the fuses depend from the cover 14 and extend inwardly toward each other from walls 72 and 74 respectively. The walls 82 and 84 extend a respective preselected distance from the respective wall 72 or 74 into the recess 28. Each wall 82 is received in a respective recess 86 and each wall 84 is received in a respective recess 88 formed in the bottom wall 20 of the base 12. The walls 82 and 84 shield the fuse terminals from each other. Each recess receives a respective partition wall 82 and 84 to a depth sufficient to enable the terminals 34 and 54 to engage terminals 38 and 56 respectively when the cover 14 is in the ON position as shown in FIGS. 3 and 5 for example. Guide walls 90 are formed on wall 20 along each longitudinal edge of each recess 86.

When however it is desired to disconnect the circuits extending between terminals 38 and 56, the cover 14 is simply lifted and rotated 180° about the vertical axis along which the cover and housing move relative each other to align the indicia OFF on the cover 14 adjacent the arrow 82 and the cover reinserted into the opening 28. As neither the wall 24 or shroud 46 have passages to receive the stop walls 80, the stop walls 80 engage the top surface of the shroud as seen in FIG. 6 before the blade terminals 34 and 54 can engage the terminals 38 and 56 despite the alignment of terminal 34 with terminal 56 and terminal 54 with terminal 38. Substantially simultaneously lugs or stops 92 projecting upwardly from the bottom wall 20 in alignment with respective walls 82 and 84 engage the bottom stop edges of walls 82 as these walls extend into recess 28, a greater distance than walls 84. The fuses 16 are thus disconnected from the respective bus bars and stored in the housing with the stored condition clearly indicated by the alignment of indicia OFF with the arrow 82. It will be noted that the spring 78 engages in a recess of the cover side wall 74 to hold the cover assembled to the base 12.

It will be appreciated that the semi-circular spring type fuse clips 36 and 52 may be replaced by fuse clips of the type adapted to receive blade-like or knife-type terminals on the fuse ends.

The foregoing is a description of an improved pullout fuse holder whose inventive concepts are believed set forth in the accompanying claims.

We claim:

1. A pullout fuse holder comprising:

a housing of insulating material having a first perimeter wall including a pair of spaced apart first side walls and a pair of spaced apart first and end walls defining a recess boundary, a plurality of pairs of spaced apart first housing terminals with one terminal of each pair carried by said housing adjacent a respective portion of a respective end wall of said first perimeter wall, one terminal of each pair spaced a respective predetermined distance apart from the other terminal of the respective pair, cover wall means of insulating material having a rim portion overlapping said first perimeter wall and including means for carrying a respective fuse for each pair of terminals at spaced positions, said cover wall means including a second perimeter wall having a pair of spaced apart second side walls and a pair of spaced apart second end walls spaced for nesting receipt in said recess boundary with each of said second side walls engaging one of said first side walls and each of said second end walls engaging one of said first end walls of said first perimeter wall in response to the alignment of each pair of cover walls with a respective pair of housing walls and the movement of said cover walls along a common axis with said housing walls into said recess, a pair of cover terminals corresponding to each pair of housing terminals to interconnect a respective pair of housing terminals with a respective fuse, each terminal of a respective pair of cover terminals spaced a respective predetermined distance apart from the other terminal of the respective pair of cover terminals and carried by said cover wall means adjacent a respective second end wall of said cover wall means for engagement with a respective one terminal of a respective one pair of housing terminals in response to the alignment of said second side walls and second end walls of said cover means in one orientation relative said first side walls and said first end walls of said housing to align each cover terminal with a respective one terminal of a respective one pair of housing terminals and the movement of said cover means along said common axis to engage each cover terminal with a respective one housing terminal and a respective one of said second side walls and said second end walls with a respective one of said first side walls and said first end walls in said recess with said rim portion of said cover wall means overlappingly engaged with said first perimeter wall, first stop means carried by said cover wall means in spaced positions, and other stop means in said housing recess at respective spaced positions engaging said first stop means in said recess for preventing engagement of any one of said cover terminals with any one of said first housing terminals in response to another orientation of said cover wall at 180° to said one orientation aligning each cover terminal with a housing terminal different than the respective one terminal and movement of said cover wall means along said axis to engage said second side walls and said second end walls of said cover wall means with the respective other first side wall and respective other first end wall and in said recess whereby said cover wall means is supported against inadvertent movement by said stop means and the engaged side and end walls with said rim portion spaced from said first perimeter wall.

2. In the pullout fuse holder claimed in claim 1, wherein said first stop means comprises a partition wall means on said cover wall means intermediate each pair of cover terminals to provide a barrier between engaged terminals of each pair of housing and cover terminals with said partition wall means having lower edge surfaces extending a different distance from each cover end wall, and said other stop means includes a bottom wall for said recess having means spaced a different distance from each housing end wall engaging said partition wall means in response to the receipt of said second side walls and said second end walls in said recess in said other orientation to prevent engagement between any of said cover terminals wth any of said housing terminals, and a plurality of passages in said bottom wall each receiving a respective extending lower edge surface of said partition wall means in response to the receipt of second side walls and said second end walls in said recess in said one orientation.

3. In the pullout fuse holder claimed in claim 2 a plurality of stop walls on said cover wall means engaging said first perimeter wall in response to the engagement of said cover side walls and end walls with said housing side and end wall in said other orientation, and passage means in said first perimeter wall for receiving said plurality of stop walls in response to said cover side walls and end walls being in said one orientation.

4. The pullout fuse holder claimed in claim 3 in which said rim portion of said cover wall means is spaced a predetermined distance from said first perimeter wall in response to said cover second walls and said cover second end walls being in said other orientation, one indicia on said housing, and a pair of spaced apart separate indicia on said cover wall means, said one indicia on said housing aligned with a respective one of said spaced apart indicia on said cover means for indicating said cover wall means is in said one orientation relative said first perimeter wall and aligned with the other spaced apart indicia on said cover means for indicating said cover wall means is in the other orientation relative said first perimeter wall.

5. In the pullout fuse holder claimed in claim 3, a shroud of insulating material secured to one end of said housing and having a plurality of vertically aligned passages, a respective bus bar terminals connected to one terminal of each pair of first terminals with each bus bar terminal including a pair of jaws projecting into a respective shroud passage for engaging a respective one of a plurality of vertically stacked parallel bus bars of rectangular cross section, said shroud having a portion overlappingly engaged with a portion of said housing to anchor one end of said housing, and an adapter overlappingly engaged by another portion of said housing to anchor the other end of said housing.

6. In the pullout fuse holder claimed in claim 5, a spring member carried by said shroud engaging one of said cover end walls in response to said cover being engaged in said one orientation with said housing for restraining axial movement of the perimeter walls relative each other.

* * * * *